United States Patent [19]

Bunch et al.

[11] Patent Number: 4,616,432

[45] Date of Patent: Oct. 14, 1986

[54] SHOE UPPER WITH LATERAL FASTENING ARRANGEMENT

[75] Inventors: Richard P. Bunch, Reading; Lloyd S. Smith, Newton Center, both of Mass.

[73] Assignee: Converse Inc., North Reading, Mass.

[21] Appl. No.: 726,504

[22] Filed: Apr. 24, 1985

[51] Int. Cl.[4] ..... A43B 11/00; A43B 23/00

[52] U.S. Cl. ..... 36/50; 36/45; 36/114; 2/DIG. 6

[58] Field of Search ..... 36/50–54, 36/114, 128, 129, 45, 102; 2/DIG. 6

[56] References Cited

U.S. PATENT DOCUMENTS

| | | | |
|---|---|---|---|
| 3,650,051 | 3/1972 | Sass | 36/128 X |
| 4,080,745 | 3/1978 | Torrance | 36/50 |
| 4,308,672 | 1/1982 | Antonious | 36/50 |
| 4,517,753 | 5/1985 | Rosenbaum et al. | 36/50 X |

FOREIGN PATENT DOCUMENTS

| | | | |
|---|---|---|---|
| 809145 | 7/1951 | Fed. Rep. of Germany | 36/129 |
| 2405091 | 8/1975 | Fed. Rep. of Germany | 36/129 |
| 1443559 | 5/1966 | France | 36/50 |
| 2375841 | 7/1978 | France | 36/50 |
| 2911 | of 1908 | United Kingdom | 36/50 |

OTHER PUBLICATIONS

ABC Schuh Fabrication, Dec. 15, 1933, p. 2250.

*Primary Examiner*—James Kee Chi

*Attorney, Agent, or Firm*—Bromberg, Sunstein & McGregor

[57] ABSTRACT

A shoe has an upper having a lateral lacing system and a band structure over the central longitudinal axis of the foot, so that the foot is retained conformally and the shoe fastening system is located over relatively planar regions of the wearer's foot. The upper has a slot disposed along a path commencing proximately to the connection of the phalanges with the metatarsus of the wearer's foot and continuing along the lateral side of the metatarsus to the top of the upper, so that the slot defines asymmetric lateral and medial panels of the upper. The medial panel overlies the central longitudinal axis of the foot and includes a plurality of bands disposed transverse to the axis. A fastening arrangement bridges the slot.

10 Claims, 7 Drawing Figures

SHOE UPPER WITH LATERAL FASTENING ARRANGEMENT

DESCRIPTION

1. Technical Field

The present invention relates to shoes, and more especially athletic shoes with lateral fastening arrangements.

2. Background Art

As the foot moves in an athletic shoe, a complex series of forces are brought to bear upon the upper, and may cause discomfort to the wearer, and, ultimately, stretching and irreversible deformation of the material of the upper. The prior art has attempted to address this problem in a number of ways.

U.S. Pat. No. 2,088,851, issued Aug. 3, 1937, for an invention of J. E. Gantenbein, shows a lacing structure for a dress shoe in which the lace holes are disposed along the medial side of the foot. International Application under the Patent Cooperation Treaty, published Mar. 4, 1982, as number #W082/00573, for an invention of R. Alberts, shows a lateral lacing system in a field sport shoe in which the lace pattern pulls a continuous sheet of material of the upper over the foot of the wearer. Also, U.S. Pat. No. 3,703,775 issued Nov. 28, 1972, for an invention of J. Gatti, shows a sheet secured over the top of the foot by lace openings on either side of the sheet, for use as a shield in a shoe. Straps having hook-and-pile type relatchable closures for use in lieu of laces on athletic shoes are also known, as shown, e.g., in U.S. Pat. No. 3,626,610, issued Dec. 14, 1971, for an invention of R. Dassler.

DISCLOSURE OF THE INVENTION

The present invention provides a shoe with an upper having a lateral lacing system and a band structure over the central longitudinal axis of the foot, so that the foot is retained conformally and the shoe fastening system is located over relatively planar regions of the wearer's foot. The upper has a slot disposed along a path commencing proximately to the connection of the phalanges with the metatarsus of the wearer's foot and continuing along the lateral side of the metatarsus to the top of the upper, so that the slot defines assymmetric lateral and medial panels of the upper. The medial panel overlies the central longitudinal axis of the foot and includes a plurality of bands disposed transverse to the axis. A fastening arrangement bridges the slot.

BRIEF DESCRIPTION OF THE DRAWINGS

These and other features will be better understood by reference to the drawings, in which.

DESCRIPTION OF THE INVENTION

Figure 1A:
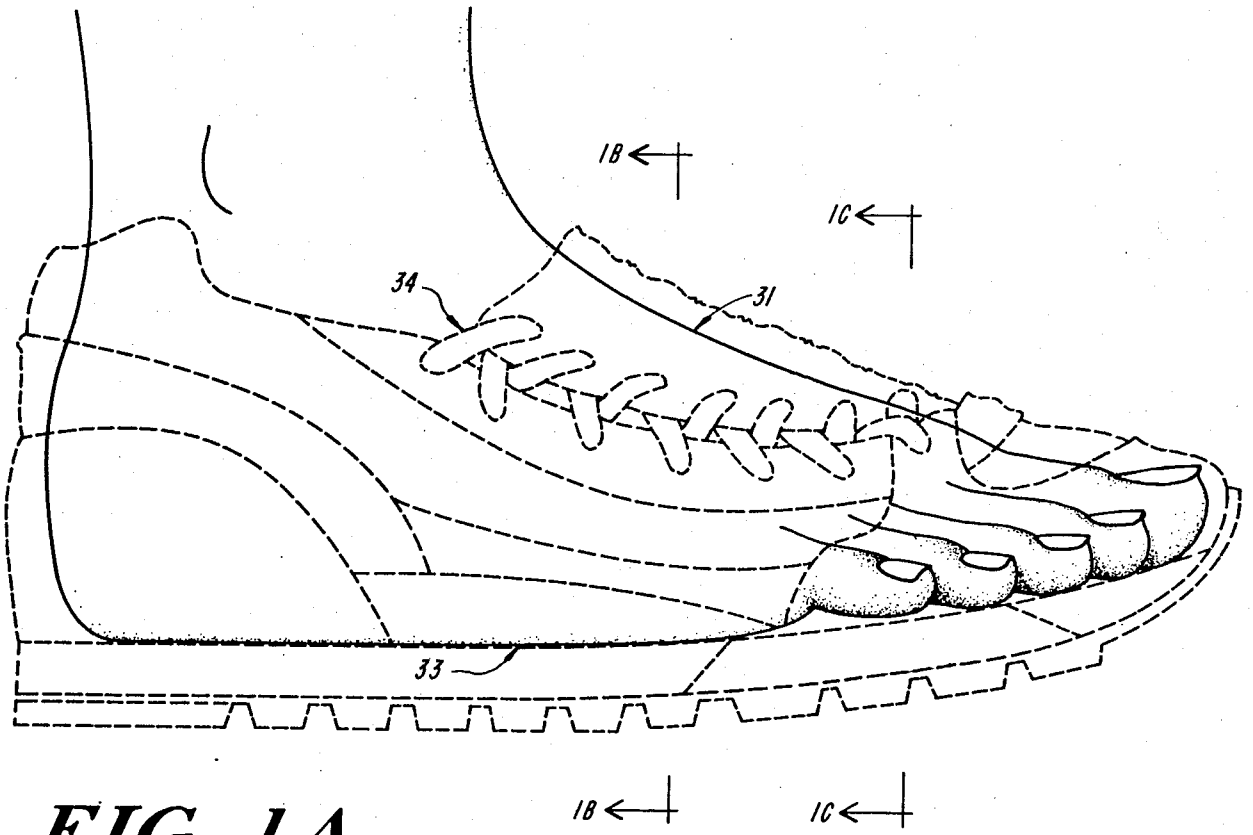
FIG. 1A shows a view of the foot in a preferred embodiment of a shoe in accordance with the present invention, the shoe being shown in phantom.
Figure 1B:
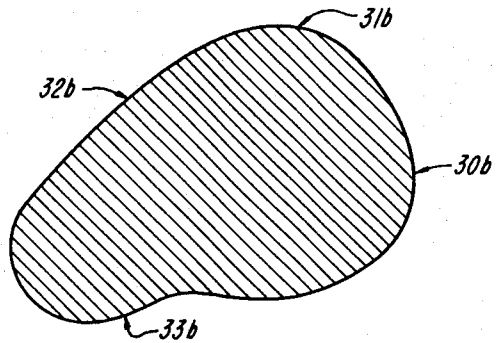
FIGS. 1B and 1C show cross sections of the foot at various points.
Figure 1C:
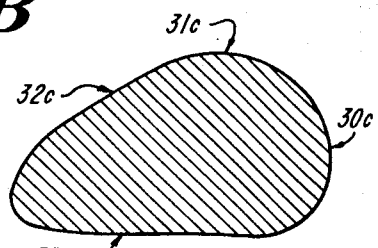

Turning now to FIG. 1A, there is shown a side view of a human foot, within a preferred embodiment of a shoe according to the present invention, as discussed more fully below. FIGS. 1B and 1C show the profile of cross sections of the foot in a plane perpendicular to its longitudinal axis at the stations indicated in FIG. 1A. As shown in FIG. 1B, the cross sectional profile of the foot, in the general region of the upper portion of the metatarsus, rises steeply along the medial side **30*b* of the foot to the dorsal metatarsal ridge 31*b* having a small radius of curvature and then slopes down, along a nearly planar surface 32*b* on the lateral side of the foot, to the base 33*b*. FIG. 1C shows a typical cross-sectional profile of the foot in the region of the frontal area of the metatarsus. As shown, the profile here also rises steeply to a height along the medial side 30*c* to the dorsal metatarsal ridge 31*c* from which it slopes down along a nearly planar surface 32*c*, on the lateral side of the foot, to the base 33*c***.

Because of the relatively small radius of curvature of the dorsal metatarsal ridge, conventional fastenings of shoes lying along this ridge have a tendency to dig in to the foot of the wearer. The present invention places the path along which the shoe is laced or otherwise fastened away from this ridge. In FIG. 1A, the dorsal metatarsal ridge is shown as item 31, and the path 34 along which the shoe is laced is shown on the medial side, and is here shown curved and located approximately midway between the ridge 31 and the base of the foot 33, although, as will be seen in connection with FIG. 2, the path commences near the vertical plane passing through the central longitudinal axis of the foot.

Figure 2:
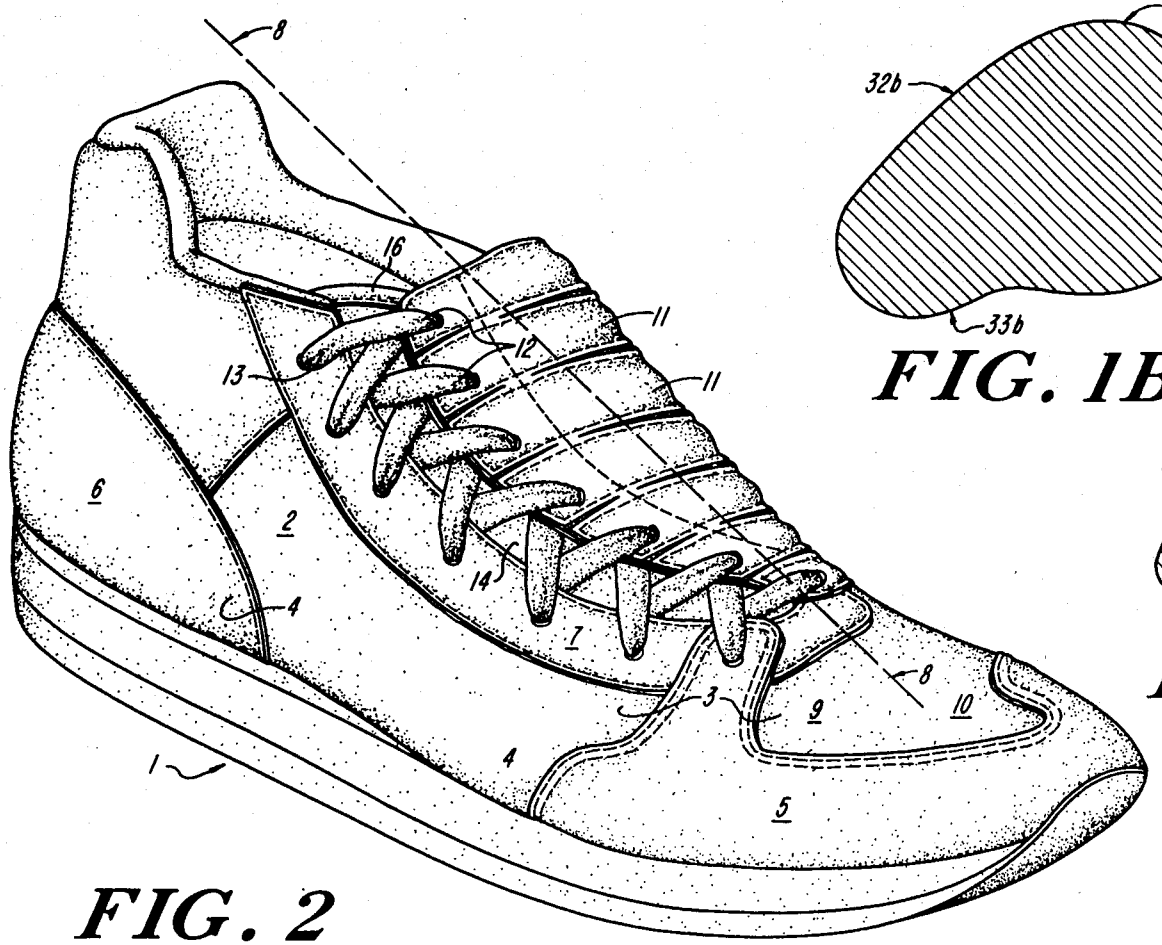
FIG. 2 shows a perspective view from the lateral side of a shoe in a preferred embodiment of the present invention.

Turning now to FIG. 2, there is shown a preferred embodiment of a shoe 1 having an upper 2 according to the present invention. The upper 2 includes regions 3 which may be of a textile or other relatively pliable material, and regions 4 formed of a leather or similarly strong and relatively inextensible material. Regions 4 may include, for instance, a toe cap 5, a counter 6, and portions 7 defining a lace opening in a manner known in the art. The portions 5, 6, and 7 made of the strong relatively inextensible material are those portions subject to extreme wear or structural stress in the upper. The shoe shown in FIG. 2 is a right shoe and is viewed from the lateral or outer side. In the shoe of FIG. 2, a center line 8 approximately bisecting the shoe, and lying in the same vertical plane as the central longitudinal axis of the shoe, is shown for ease of reference in the following discussion. On one side of line 8 is a lateral panel 9 of the upper extending down to the sole on the lateral side of the shoe; on the other side of line 8, a medial panel 10 of the upper extends downwardly to the sole on the medial side. The lateral and medial panels 9 and 10 together are defined by the slot 14 which, in the example shown, comprises the lace area of the shoes. Laces or other fastening means serve to bridge the slot and thus to secure the upper around the foot of the wearer. The slot commences near the connection of the phalanges with the metatarsus and also near the center line 8, and then continues along the medial side of the foot, as discussed in connection with FIG. 1A. The panel includes a series of bands 11 disposed transverse to the central longitudinal axis of the foot.

The tension of fastening the sides of the upper together is transmitted along the bands 11, which lie substantially conformally against the surface of the foot. The band structure serves both to prevent the transmission of irregular pulling stresses from region to region of the upper except along the bands, and also serves to allow each band to conform individually to the curved surface of the foot.

Figure 3:
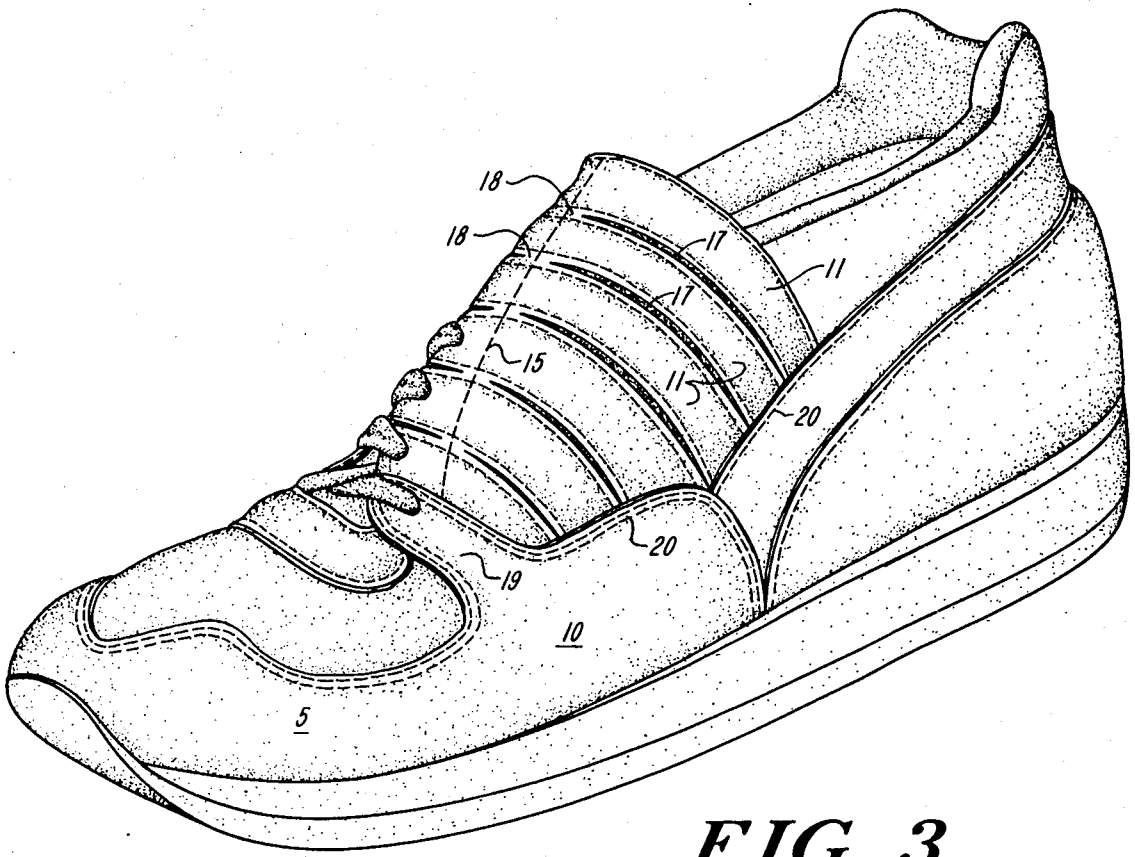
FIG. 3 shows the shoe of FIG. 2 from a medial side perspective.

FIG. 3 shows, from the medial side of the shoe of FIG. 2, a perspective view in which the medial panel 10 appears more fully. Bands 11 are generally parallel and formed of a single sheet separated along incision lines 17. Incision lines 17 extend substantially the length from one end of the portion formed by bands 11 to the opposing end, with the exception of small unincised portions 18 defining a strip of continuity extending from the front central portion of the shoe rearwardly across center line 8 (shown in FIG. 2). Through the center of the strip of continuity is a seam 15 to which a tongue 16 (shown in FIG. 2) is stitched. Seam 15 follows a curve approximately parallel to the slot 14 defined by sides 9 and 10 and extending along the lateral side of the shoe. Each band 11 further has an aperture 12 at an end thereof through which the lace 13 passes to close the shoe. The surface formed of bands 11 may also have cushioning and fabric lining layers, not shown, fastened to the underside thereof in a manner known in the art. The fabric may in some embodiments be made more yieldable under tension than the material out of which the bands are formed. Furthermore, among the bands 11 may be included a band 19 that is an extension of a toe reinforcement panel 5. Each of the bands 11 extends on the medial side to a point where it is firmly anchored, either by attachment to the last, or by fastening to the external leather panels, as along seam 20.

Figure 4:
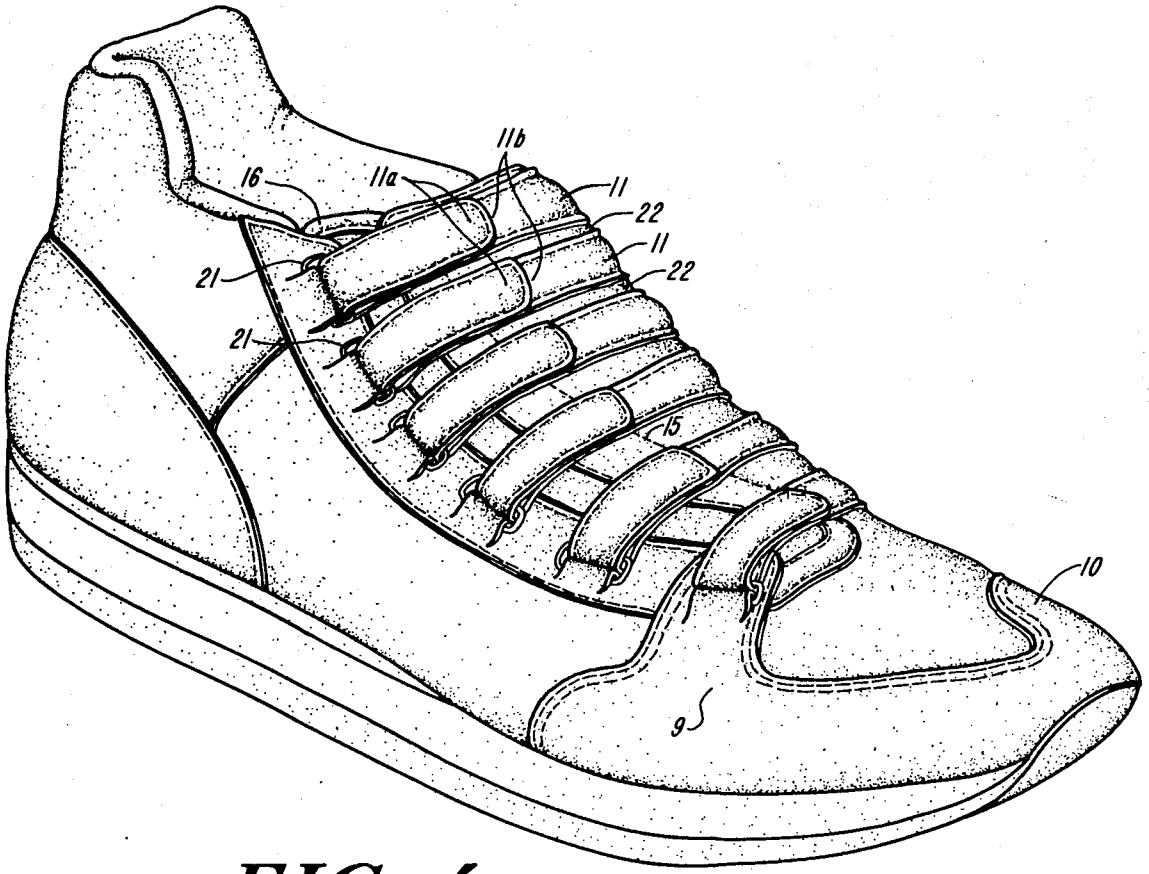
FIG. 4 shows a shoe in a second preferred embodiment of the invention.

Turning now to FIG. 4, there is shown another embodiment of the invention, in which bands 11 attach to the opposing side 9 by a relatchable fastener of the hook-and-pile type. In the embodiment shown, each band end 11*a* bears hook or pile fastening material and is threaded through an eyelet 21 of side 9 and doubled over to relatchably fasten to a mating portion 11*b* of pile or hook material, respectively, on the surface of the band. The bands may form a continuous sheet over the top surface of the instep, but may also be separated, for example, by shorter bands 22 for ease of fastening. This structure may be formed by a series of partial parallel incisions in a sheet as discussed above in relation to FIG. 2, but with only the alternate pairs of bands of the sheet extending all the way to and through the eyelets so as to define spaced-apart straps for fastening. As in the embodiment of FIG. 2, a tongue 16 may be provided, and is stitched to the band surface along the seam 15.

In each of these embodiments, because of the lateral placement of the opening and the placement of the fasteners away from the dorsal metatarsal ridge of the foot, the tongue is not required to provide the same degree of cushioning as a conventional tongue, and may accordingly serve as much as a seal against moisture, dirt, pebbles and the like. Accordingly, the tongue, if provided at all, may be relatively thin and pliable. The diagonal attachment seam 15 maintains the tongue in a proper orientation.

Figure 5:
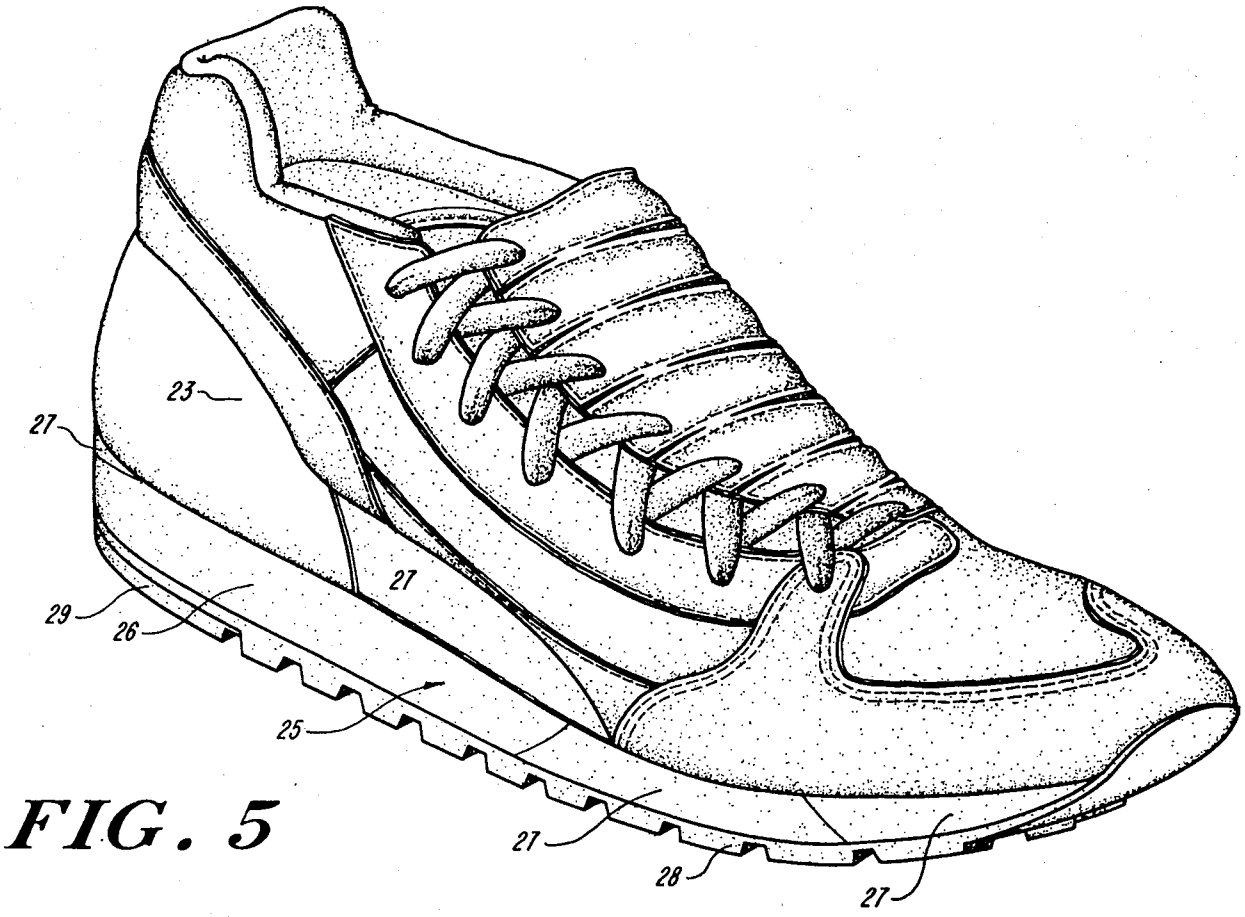
FIG. 5 shows a perspective view of an embodiment similar to that shown in FIG. 2, but incorporating an external counter structure.

FIG. 5 shows a further preferred embodiment of the invention, similar to that shown in FIG. 2, but in which the band structure and lateral lace system of the present invention are used with a rigid exterior counter structure 23 mounting below a wedge 24. This embodiment has a midsole 25 having firm regions 26 and softer regions 27, and also has an outsole 28. Outsole 28 may also have a heel support region 29 of density greater than the main portion of the outsole. This exterior counter structure is the subject of a separate patent application, by the present inventors jointly with Rui M. Parracho and Alexander Louis Gross, filed contemporaneously with the present application.

What is claimed is:

1. A shoe comprising:

an upper having a slot disposed along a path, over relatively planar regions of the wearer's foot, such path commencing proximate to the connection of the phalanges with the metatarsus of the wearer's foot and continuing along the lateral side of the metatarsus to the top of the upper, such slot defining asymmetric lateral and medial panels of the upper, wherein the medial panel overlies the central longitudinal axis of the foot and includes a plurality of bands disposed transverse to such axis, and fastening means for adjustably fastening the lateral and medial panels to one another so that the tension of fastening the lateral and medial panels together is transmitted along the length of the bands.

2. A shoe according to claim 1, wherein the medial panel includes a first sheet of material in which have been formed a plurality of incisions disposed transverse to the central longitudinal axis so that the bands are defined by the regions of the first sheet lying between pairs of adjacent incisions.

3. A shoe according to claim 2, wherein the medial panel further includes a second sheet of material attached to the first sheet to hold the bands in substantially parallel alignment.

4. A shoe according to claim 3, wherein the second sheet of material is more yieldable under tension than the first sheet of material.

5. A shoe according to claim 3, wherein the first sheet is selected from a class of materials consisting of leather and leather substitutes, the second sheet is a woven fabric, and each band in the first sheet is stitched to the second sheet.

6. A shoe according to claim 4, wherein the first sheet is selected from a class of materials consisting of leather and leather substitutes, the second sheet is a woven fabric, and each band in the first sheet is stitched to the second sheet.

7. A shoe according to claim 3, wherein the path is curved so as to commence proximate to vertical plane passing through the central longitudinal axis of the foot and to continue approximately midway between the dorsal metatarsal ridge and the base of the foot, such curve having a positive radius of curvature measured from a position above the malleolus.

8. A shoe according to claim 5, wherein the path is curved so as to commence proximate to vertical plane passing through the central longitudinal axis of the foot and to continue approximately midway between the dorsal metatarsal ridge and the base of the foot, such curve having a positive radius of curvature measured from a position above the malleolus.

9. A shoe according to claim 2, wherein the bands and the fastening means collectively include (i) a series of straps attached to one of the lateral and medial panels proximate to the slot and (ii) attachment means for removably attaching each of the straps to the other of the lateral and medial panels proximate to the slot.

10. A shoe according to claim 9, wherein each strap has an end and the attachment means includes (i) a series of eyelets mounted on the other of the lateral and medial panels, each eyelet for removably receiving a strap, and (ii) mating hook-and-pile materials mounted on each strap, so that the end of each strap may be threaded through one of the eyelets, partially doubled over to contact a region of such strap not having passed through such eyelet, and removably and adjustably attached at a location in such region.

* * * * *